United States Patent [19]

Cartwright

[11] Patent Number: 4,650,185

[45] Date of Patent: Mar. 17, 1987

[54] EXERCISE MACHINE WITH IMPROVED LOAD VARYING ARRANGEMENT

[76] Inventor: Richard D. Cartwright, Rte. 3, Box 1107, Beaverton, Oreg. 97005

[21] Appl. No.: 574,174

[22] Filed: Jan. 26, 1984

[51] Int. Cl.[4] ..... A63B 21/06

[52] U.S. Cl. ..... 272/117; 272/129

[58] Field of Search ..... 272/129, DIG. 4, DIG. 6, 272/134, 117

[56] References Cited

U.S. PATENT DOCUMENTS 3,573,865 4/1971 Annas et al. ..... 272/117
3,588,101 6/1971 Jungreis ..... 272/117
4,256,302 3/1981 Keiser et al. ..... 272/134
4,422,636 12/1983 de Angeli ..... 272/117

*Primary Examiner*—Richard J. Apley
*Assistant Examiner*—James Prizant
*Attorney, Agent, or Firm*—Klarquist, Sparkman, Campbell, Leigh & Whinston

[57] ABSTRACT

An exercise machine having a beam pivoted off center, with a weight movable along the beam under control of a motor. A cable connects the beam to a handle or other device for assumption by the excerciser of the load created by the weight. The weight can be moved over center for counterbalancing purposes.

1 Claim, 5 Drawing Figures

EXERCISE MACHINE WITH IMPROVED LOAD VARYING ARRANGEMENT

This application relates to exercising machines and particularly to a declining weight exercise machine.

Heretofore, most exercise machines of which I am aware have had no provision for declining the load as the repetitions of an exercise proceed. I am aware of the "Queststar" (formerly called Triton). It uses water as a weight source, with means to pump water from the loading zone to decline the load as the exercise session continues. The machine is very costly to build and to maintain. Also, it has only one rate at which the load declines or inclines.

SUMMARY OF THE INVENTION

My invention overcomes the above disadvantages by providing a machine that allows for a wide range of rates of weight declining and inclining. It also enables readily changing of the magnitude of the "set" load.

These aims are accelerated by proving a pivoted levertype beam having a weight that is shiftable along the beam by a motor, the beam being connected by a pulley arrangement to a handle device by which a person may exert forces against the load.

My machine also provides for a soft start, which is provided by a unique "CAM" effect mounting of the beam.

While the weight shift can be attained by pushing control buttons on a motor, I prefer to use microprocessor control.

The subject matter which I regard as my invention is particularly pointed out and distinctly claimed in the concluding portion of this specification. The invention, however, both as to organization and method of operation, together with further advantages and objects thereof, may be best understood by reference to the following description, taken in connection with the following drawings, wherein like reference characters refer to like elements.

Figure 1:
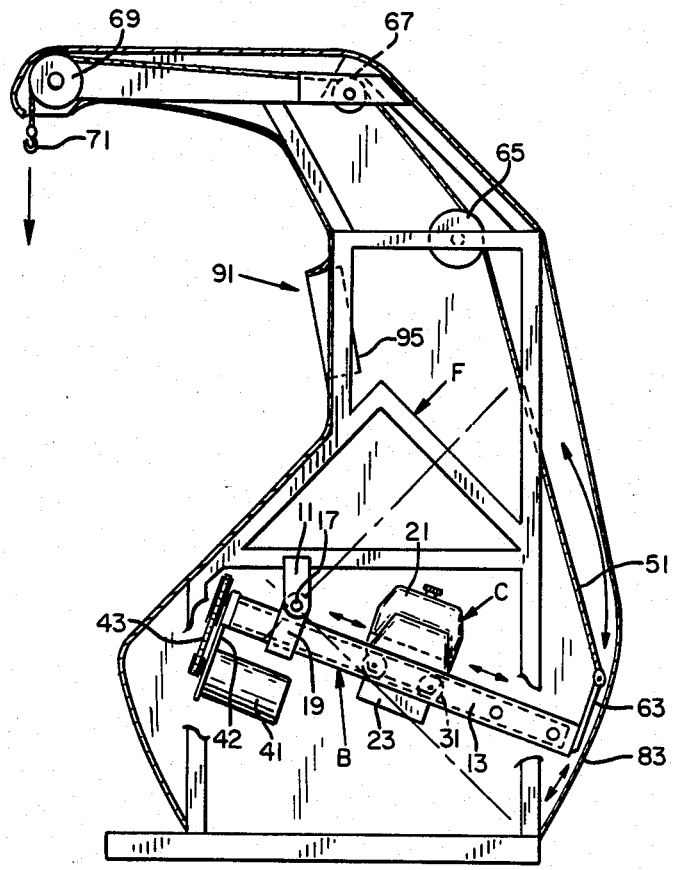
FIG. 1 is a schematic side elevational view of a machine of my invention.
Figure 3:
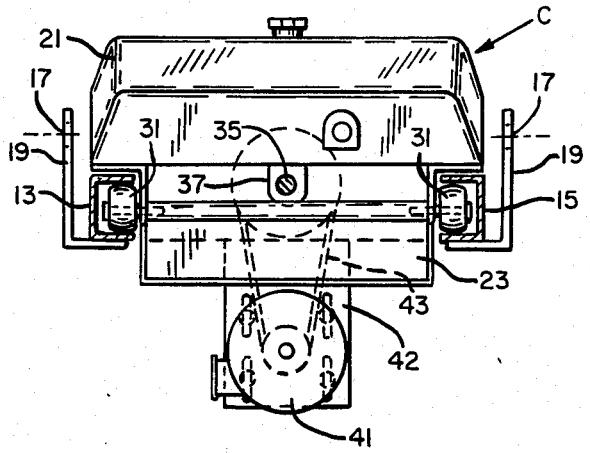
FIG. 3 is an enlarged view taken in cross section of FIG. 2.

Referring to FIG. 1, the machine has a frame F equipped with a hanger 11. A beam B having rails 13 and 15 (FIG. 3) is pivoted at 17 on the hanger by support members 19, at a place spaced above the center line of the beam.

A weight carriage C has wheels 31 fitting in the channel-like rails 13 and 15. The carriage has an upper cannister 21 and a lower cannister 23 to receive lead shot.

Figure 2:
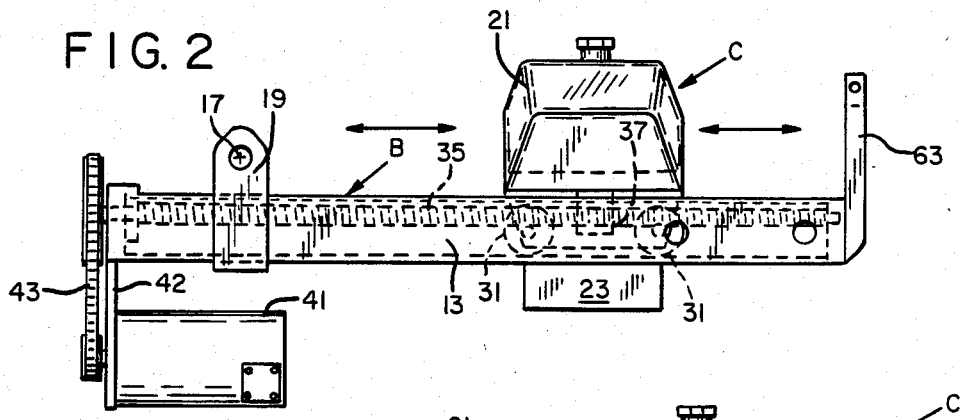
FIG. 2 is an enlarged view of the beam assembly.

A reciprocating ball lead screw 35 is mounted on the beam B and engages a nut 37 (FIG. 2) on the weight carriage. The screw is driven by a D.C. electric motor 41, hung at 42 from the beam, via a drive unit 43, which has a speed reduction effect.

It is evident that operation of the motor drives the weight carriage in a desired direction along the beam to vary the load imposed by the machine. Note that the carriage can move past the support members 19 to a position at the left-hand end of the beam.

The load created by the weighted beam is applied to a cable 51 connected to a lateral arm 63 on the beam. The cable is reeved over sheaves 65, 67 and 69, mounted on the frame F.

Figure 4:
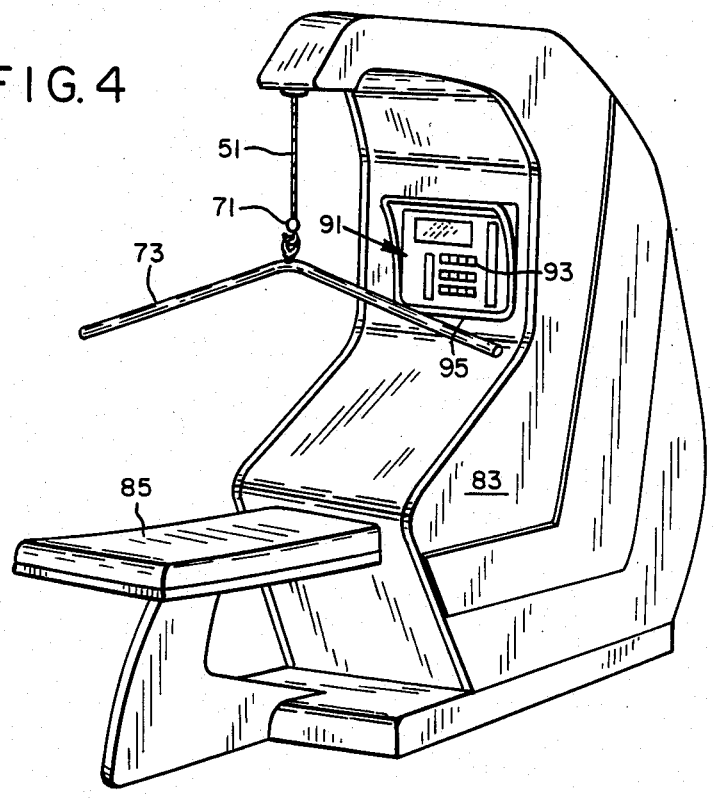
FIG. 4 is a perspective view of the machine enclosed within a housing.

The cable has a connecting device 71 (FIG. 1), such as a hook, to enable use of various kinds of handle devices with the machine. FIG. 4 shows a pull-down bar 73, as one example.

The lateral extension permits the carriage to be moved to the remote end of the beam without interference by the presence of the cable.

The FIG. 1 structure is enclosed within a housing or casing 83. Various benches, such as bench 85 in FIG. 4 may be used.

Leg exercising may be achieved by routing cable 51 to a leg engaging device (not shown) associated with the bench 85.

Operation

The motor will be energized to move the weight carriage to a desired initial position. Then the person will pull on the handle to raise the beam, and then allow the beam to pull the handle back to its beginning position. Note that the effect of the pivot offset means that the load is less, and thus "soft", when the beam is tilted down, but greater when above the horizontal.

It is evident that during an exercise period, that the weight carriage can be shifted inwardly to "decline" the load in any progressive manner desired. Ideally, this is accomplished by a microprocessor 91 (FIG. 1), but other control means could be used. Also, the load could be made to "incline" if desired, by shifting the weight outwardly as the repetitions increase.

Figure 5:
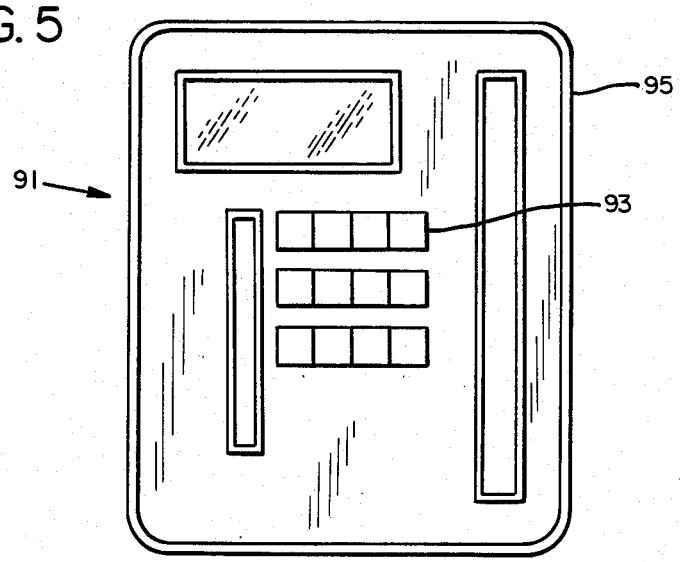
FIG. 5 is a front view of a control box.

Microprocessor controls 93 (FIG. 5) of a control box 95 enable control of the microprocessor.

What is claimed is:

1. An exercise machine comprising a beam, pivot means for pivoting the beam near or at one end thereof, said pivot means providing a pivot axis weight means on said beam, motor means for mounting said weight means to various positions along the beam to vary the load, means connected to the other end of the beam for exercising purposes, said pivot means providing said pivot axis in offset relation to the centerline of said beam, said offset being above the axis of said beam so as to make for a decreased loading effect when the beam is below the horizontal but an increasing load effect when the beam is above the horizontal.

* * * * *